US005117522A

United States Patent [19]

Everett

[11] Patent Number: 5,117,522

[45] Date of Patent: Jun. 2, 1992

[54] LEG PILLOW

[76] Inventor: Peter M. Everett, 88 Panter Crescent, Ajax, Ontario, Canada, L1S 3T6

[21] Appl. No.: 675,826

[22] Filed: Mar. 27, 1991

[51] Int. Cl.[5] ..... A47G 9/00

[52] U.S. Cl. ..... 5/648; 5/449; 5/455; 5/644

[58] Field of Search ..... 5/443, 444, 431, 437, 5/436, 441, 449, 455; 128/80 A, 80 R, 78, 88, 882; D6/601, 604

[56] References Cited

U.S. PATENT DOCUMENTS 4,177,806 12/1979 Griffin ..... 5/443
4,584,730 4/1986 Rajan ..... 5/431
4,736,477 4/1988 Moore ..... 5/443
4,754,510 7/1988 King ..... 5/431
4,910,818 3/1990 Grabill et al. ..... 5/443

*Primary Examiner*—Alexander Grosz
*Attorney, Agent, or Firm*—Kenneth M. Garrett

[57] ABSTRACT

A pillow for use in supporting the legs of a person in bed comprises an I beam of resilient foam material having a V notch located towards one end thereof. The apex of the V notch locates proximate one of the flanges whereby it acts as a hinge for flexure of the flanges in the plane of the web thereof. A second pillow having a truncated triangular prismatic shape may be used with the first pillow in transverse relation through the notch, to provide support for the knees when raised.

18 Claims, 3 Drawing Sheets

FIG. 5

LEG PILLOW

FIELD OF INVENTION

This invention relates to a therapeutic pillow having particular use for retaining the legs of a person in general parallelism, while permitting flexure of the legs at the knees.

BACKGROUND OF THE INVENTION

Recommended therapy for several medical conditions requires that the legs of the patient be supported and maintained in parallel planes.

It is also desirable under certain conditions that when the patient is in a supine position, the knees be supported in a flexed position. It is still further desirable in some instances to provide support for bedcovers to prevent discomfort to injured or painful limbs.

A conventional pillow is often used for the above purposes. However, it usually requires frequent adjustment, generally necessitating the assistance of another person, particularly when the patient desires to move between a supine and a lateral decubitus position.

In U.S. Pat. No. 4,584,730 (Rajan) there is disclosed a planar foam body for positioning between the legs, and upstanding wall portions along end lateral edge of the body to retain the legs of a user in a desired lateral position. No provision is made for flexure of the pillow at the knees of the user.

In U.S. Pat. No. 4,736,477 (Moore) there is disclosed a knee pillow. A V notch of limited depth is provided in one lateral side, of the pillow, and a plurality of slits are provided in the opposed lateral side to facilitate flexure of the pillow at the knee.

The instant invention seeks to provide a leg pillow for maintaining the legs in parallelism while permitting the pillow to flex at the knee joint.

It also seeks to provide a leg pillow that may be used by patients with little or no assistance from other persons for the adjustment of the pillow. It further seeks to provide a leg pillow that will assist in supporting bed covers.

It still further seeks to provide a leg pillow system that will support the knees in a raised, flexed position.

SUMMARY OF THE INVENTION

In accordance with one aspect of the invention a therapeutic pillow comprises an axial elongated resilient body including first and second axially elongated portions suitably of resilient foam material, each portion including a web and a flange extending along each lateral side of the web, the portions having an I beam cross-section. A hinge interconnects the portions in end to end relationship, the hinge locating at one lateral side of the portions. The facing end of each portion together form a notch extending through the flange opposite the hinge and substantially across the web of the portions, to permit the portions to pivot on the hinge between a first position wherein the portions are collinear and a second position wherein the facing ends are in abutment.

Suitably and preferably, the hinge is formed by the flange at the one lateral side.

In another embodiment of my invention the I beam is inflatable and comprises a plurality of cells inter-connected in gas flow relationship.

It is generally desirable that one portion, which may be referred to as the upper portion, have a length to extend from the knee to about between the mid-thigh to upper mid-thigh, and that the other portion, which may be referred to as the lower portion, have a length equal to at least about one half of the length of the tibia of a patient, and preferably be as long as the tibia. However, in accordance with one embodiment for use wherein it is desired to control the position of the feet, the length of the lower portion of the pillow is increased, and the distal end thereof is shaped to accommodate the foot.

It will be appreciated from the foregoing that the axial dimensions are not critical, and that they will vary according to the approximate height of the intended user. Generally speaking the ratio of the length of the upper and lower portions, as measured along the hinge side thereof, will be in the ratio of about 1 to 1 to about 1 to 2, with a ratio of about 1 to 2 being preferred.

The lateral width of the pillow is not critical. Although a leg will usually taper from thigh to ankle, it does not appear to be necessary that the width of the pillow conform to that of the leg along its length, although this is not precluded. Generally speaking, for an adult person the width of the pillow may be about three-quarters of the length of the tibia, and typically about 30 cm (12 inches), of which the width of web may comprise approximately three-quarters of the total. Accordingly, the aspect ratio of the pillow i.e. the ratio of the length to the width, may typically be in the ratio of about 1.5 to 1 to about 2.5 to 1, with ratios of between about 2 to 1 to about 2.5 to 1 being preferred as permitting a small degree of scissor movement of the legs in parallel planes.

The miter angle of the notch is not critical; preferably it will permit the portions of the pillow to move on the hinge from a collinearity through an arc of at least about 60°, and preferably about 120°, before the facing ends of the portions are in abutment. Typically the notch will have a depth as it intersects the flange opposed to the hinge of approximately equal to the width of the pillow.

The invention comprises a second pillow for use in conjunction with the above described pillow. The second pillow is in the form of a truncated triangular prism, having a cross-section which is generally that of an isosceles triangle having a truncated apex. The base of the triangle is approximately equal to its height, which is approximately one half of the width of the first pillow. The second pillow may suitably have a length somewhat greater than that of the tibia of the intended user, although this is not critical. In use, the second pillow is placed in the notch of the first pillow, so as to extend transversely on each side thereof, whereby it will locate on the bend of the knees of a patient to elevate the knees and flex the hip and knee joints. The cross-sectional width of the second pillow, being substantially less than the maximum width of the notch opening in the first pillow, permits the first pillow to close partially on the hinge, whereby the first pillow will automatically tend to assume the angle of the legs of the user.

These foregoing objects and aspects of the invention, together with other objects, aspects and advantages thereof will be more apparent from the following description of a preferred embodiment thereof, taken in conjunction with the following drawings.

DESCRIPTION OF THE PREFERRED EMBODIMENT

Figure 1:
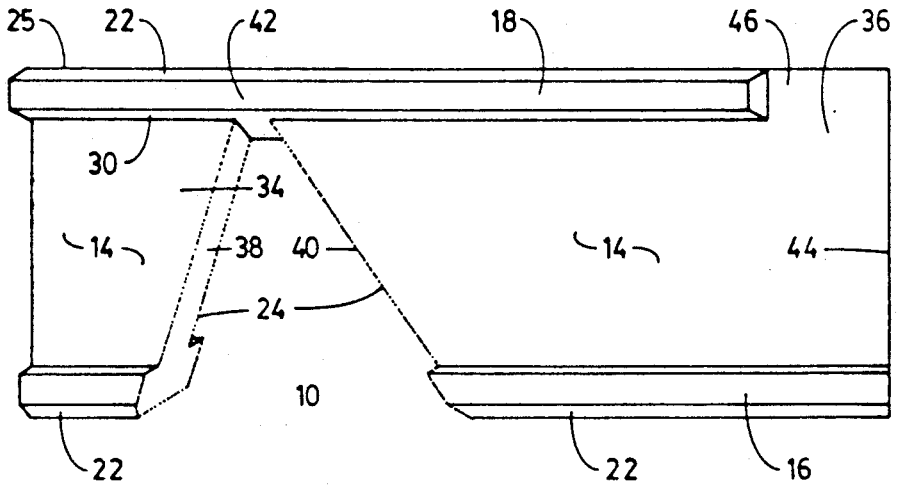
FIG. 1 shows in perspective view a first therapeutic pillow in accordance with the invention.
Figure 2:
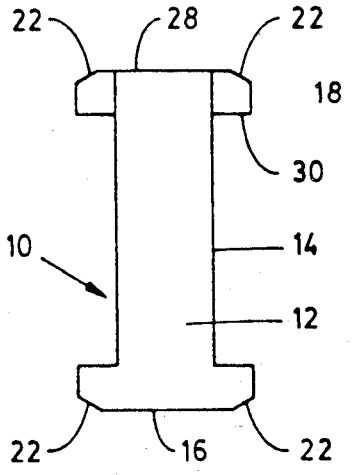
FIG. 2 is an end elevation of the pillow of FIG. 1.
Figure 3:
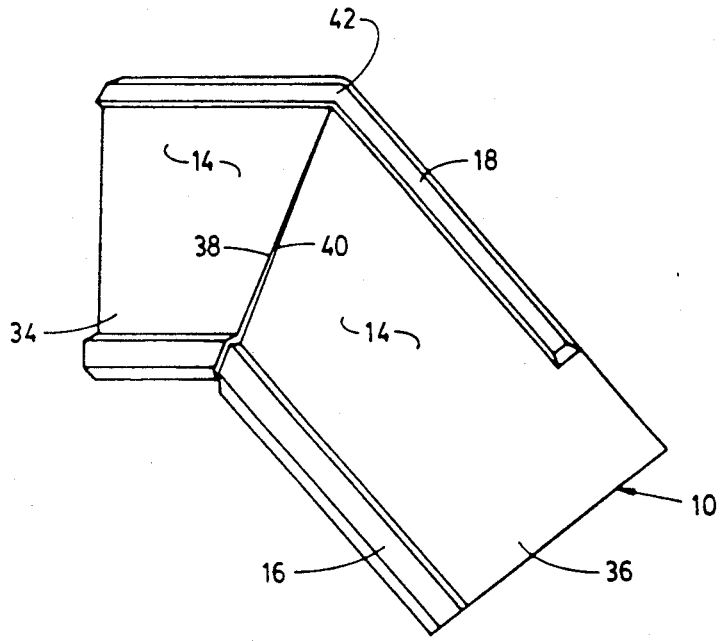
FIG. 3 is similar to FIG. 1 but shows the pillow flexed to an angular, closed position.

Referring to the drawings in detail, a first pillow in accordance with the invention is indicated in FIGS. 1-3 thereof generally by the numeral 10. Pillow 10 may be considered to be formed by carving an I beam 12 having a constant cross-section along its length as indicated in FIG. 2. It should however be appreciated that the pillow 10 may be constructed in any convenient manner e.g. by molding, carving or glue-up or combinations thereof or by using such other techniques as may be convenient or desirable. I beam 12 is formed from a medium density resilient plastic foam material, and includes a thick planar web 14 and flanges 16, 18 which are differentiated for the purposes of description, but which are generally identical, the I beam having two planes of symmetry thereto. Each flange 16, 18 is bevelled at 22 along its outer facing edge for a purpose to be described. A V notch 24 having an angle of approximately 110° which may be referred to as the notch angle or miter angle is cut in I beam 12 about one third of the way along its length. Notch 24 has a notional apex which locates proximate the upper surface 28 of flange 18, the notch being truncated proximate the lower surface 30 of flange 18. In effect, notch 24 may be considered to divide I beam 12 into a first, upper portion 34 and a second, lower portion 36. The portions have facing ends 38, 40 and are joined together by flange 18 at a zone 42 thereof adjacent the notional apex of notch 24, which zone functions as a hinge and may therefore subsequently be referred to as hinge 42.

The pillow 10 of this embodiment is of a type which is intended to extend to support the feet of a patient, and typically the length of lower portion 36 as measured from hinge 42 to the distal end 44 of web 14 will be approximately 50 cm (20 inches) where the pillow is intended for use by an average size adult. The flange on the side of the pillow on which hinge 42 is located, which is to say flange 18, is cut away adjacent distal end 44 to form a lacuna 46 to provide a toe opening. In the event that it is not desired that pillow 10 support the feet of a patient, the bottom 10 to 12 cm (4 to 5 inches) of the pillow in its illustrated form would be omitted.

As seen in FIG. 3, pillow 10 will flex on hinge 42 to permit the facing ends 38, 40 of upper and lower portions 34, 36 to move into abutment, whereby the upper and lower portions will intersect at the miter angle of notch 24. The ability to flex the pillow in proximity to the knee joint promotes the comfort of the patient and also in many instances it promotes a therapeutic action by permitting movement of the knee and hip joints. Also of importance, the flexure of pillow 10 at the knee joint assists in retaining the legs in parallelism, particularly where the patient shifts between the supine and decubitus positions. It is found that the bevelled edges 22 of flanges 16 and 18 assist this movement by reducing hang-up of the pillow on covering bedding with which the pillow 10 will normally be used, even though the pillow will normally be covered by a loose fitting cover (not shown). Circumscribing straps (not shown) may be used to assist in maintaining the legs in parallelism.

Figure 5:
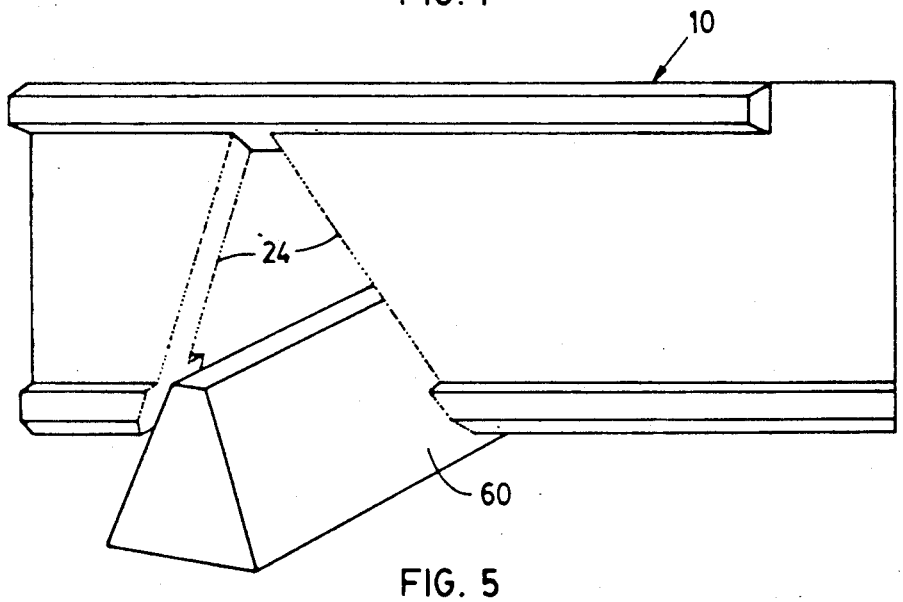
FIG. 5 shows in perspective view the first and second pillows of the invention in combination.
Figure 4:
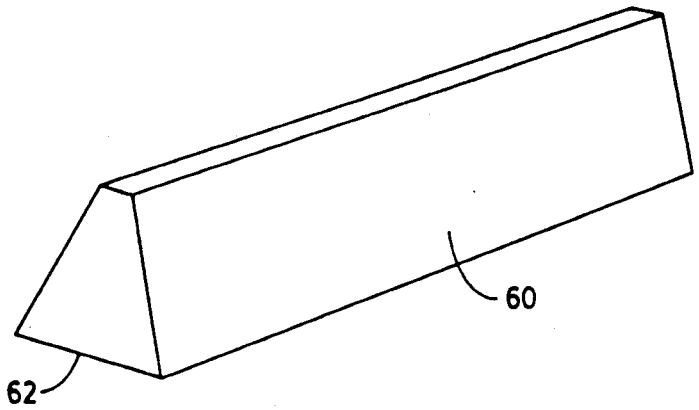
FIG. 4 shows in perspective view a second pillow in accordance with the invention for use with the first pillow.
Figure 6:
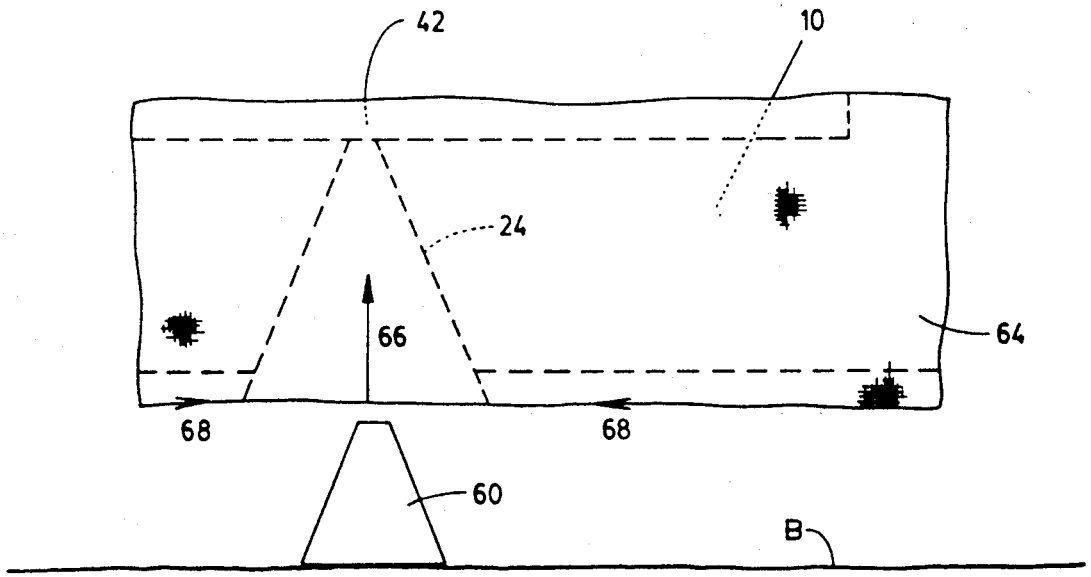
FIG. 6 shows in side elevation the first pillow covered in a fabric case therefor, positioned above the second pillow, as the two pillows are assembled together for use.

In certain instances, particularly where the patient is required to lie relatively immobile in a supine position, it is desirable that means be provided to elevate the knees. For this purpose there is provided a second pillow 60, seen in FIGS. 4 and 5. Pillow 60 is prismatic and has a truncated triangular cross-section, width of the base 62 of the pillow and height thereof each being approximately one half the width of notch 24 where it intersects flange 16. In use, pillow 60 is surmounted by pillow 10 by being received in notch 24 so as to project on each side thereof, as seen in FIG. 5. The length of pillow 60 will be such as to extend outwardly somewhat beyond the knees of a patient, and will conveniently be about equal to the axial length of the lower portion 36 of pillow 10. With pillows 10 and 60 positioned as shown in FIG. 5 there is a substantial clearance between pillow 60 and ends 38, 40. This permits pillow 10 to flex on hinge 42, whereby the upper and lower portions 34, 36 may assume an angled relationship approximately equal to the angle at which the legs of a patient will be flexed by elevation at the knees on pillow 60. This flexure of pillow 10 will arise automatically as pillows 10 and 60 are assembled together, as will be best appreciated from a consideration of FIG. 6, which shows pillow 10 in dashed outline, covered by a relatively inextensible pillow case 64 which spans over notch 24, and which is positioned vertically above pillow 60, which locates on the surface of a bed B. As covered pillow 10 is urged downwardly onto pillow 60, the pillow case 64 will be forced upwardly in the direction of the arrow 66 into notch 24. This will create a tensile force on pillow case 64 in the direction of arrows 68, which will result in flexure of pillow 10 at hinge 42, and notch 24 will close onto pillow 60.

Figure 7:
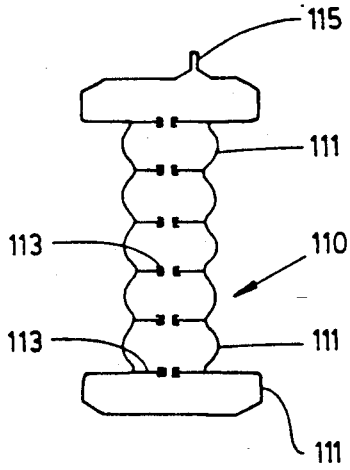
FIG. 7 is a transverse cross section of a second embodiment illustrating an alternative mode of construction of the first pillow.
Figure 8:
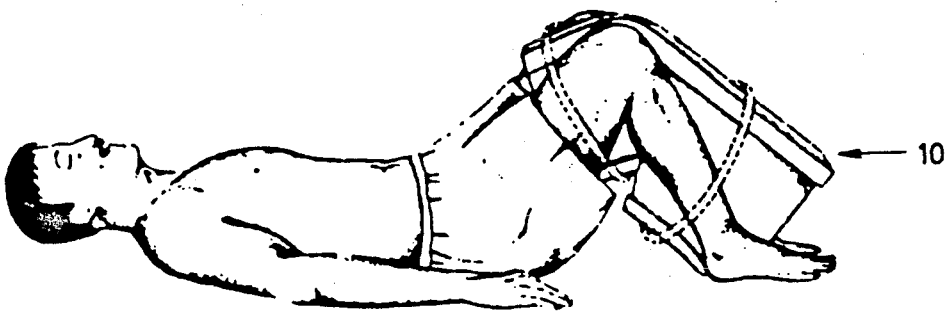
FIG. 8 is similar to FIG. 3 but shows a user's legs positioned on the pillow.

Referring now to FIG. 7, this illustrates a first pillow 110 which is similarly proportioned to pillow 10 but which differs therefrom in its mode of construction. Pillow 110 is suitably built-up from plastic sheet material to form a plurality of cells 111 which are inter-connected in gas flow relationship by channels 113 in divider walls between adjacent cells, this type of structure being well known in inflatable mattresses and the like, to provide the requisite profile without ballooning. A nipple 115 is provided to permit the inflation or deflation of pillow 110 as desired.

It will be apparent that many changes may be made to the illustrative embodiment, while falling within the scope of the invention and it is intended that all such changes be covered by the claims appended hereto.

I claim:

1. A therapeutic pillow comprising:

an axially elongated body including first and second axial portions of resilient material;

each said portion including a web and a flange extending along each lateral side thereof together having an I beam cross-section;

a hinge located adjacent one lateral side thereof interconnecting said portions in end to end relationship;

said ends adjacent said hinge being notched at a miter angle to permit said portions to pivot on said hinge between a first position wherein said portions are generally collinear and a second position wherein said ends are in abutment.

2. A therapeutic pillow as claimed in claim 1, wherein said body is formed of foam material.

3. A therapeutic pillow as claimed in claim 1, wherein said body is inflatable.

4. A therapeutic pillow as claimed in claim 1, wherein said hinge is formed by said flange at said one lateral side.

5. A therapeutic pillow as claimed in claim 4, wherein the flange of the longer of the portions is provided with a lacuna at the distal end thereof on said one lateral side to provide a toe opening.

6. A therapeutic pillow as claimed in claim 1, wherein said miter angle is about sixty degrees.

7. A therapeutic pillow as claimed in claim 1, wherein said axial lengths of said portions where measured along said one lateral side are in the ratio of between about 1 to 1 to about 1 to 2.

8. A therapeutic pillow assembly for the legs comprising:

first and second pillows;

said first pillow comprising an axially elongated web having a notch opening therein to permit portions of said web opposed sides of said notch to close on said notch and assumes an angular relationship;

said second pillow having a truncated, triangular prismatic form;

said pillows being used with the first pillow surmounted on said second pillow with said second pillow extending transversely through said notch on each side of said web;

said second pillow having a cross-section substantially less than that of said notch opening to permit said first pillow to move towards the assumption of said angular relationship.

9. A therapeutic pillow assembly as defined in claim 8, wherein at least said first pillow is covered by a pillow case which spans across said notch opening.

10. A therapeutic pillow for use in positioning the legs of a patient comprising an axially extending I beam of resilient foam material including a web and a flange on laterally opposed sides thereof;

said I beam having a miter opening extending through one said flange and the web to adjacent the other said flange to permit said I beam to flex on the other said flange to close said miter opening whereby portions of said beam on axially opposed side of said miter opening may assume an angled relationship.

11. A therapeutic pillow as defined in claim 10, wherein said miter opening locates closer to one axial end of the beam than to the other.

12. A therapeutic pillow as defined in claim 10, wherein said miter opening locates about one third of the length of the beam from one end thereof.

13. A therapeutic pillow as defined in claim 10, wherein said beam has an aspect ratio in the range of between about 1.5 to 1 to about 2.5 to 1.

14. A therapeutic pillow as defined in claim 13, wherein said aspect ratio in the range of between about 2 to 1 to about 2.5 to 1.

15. A therapeutic pillow as defined in claim 10, wherein said miter opening has an angle of about sixty degrees.

16. A therapeutic pillow as defined in claim 11, wherein a lacuna is provided in said other flange adjacent said other axial end to provide a toe opening.

17. A therapeutic pillow for use in positioning the legs of a patient comprising:

an inflatable I beam, having a web and a flange extending along each lateral edge thereof;

said I beam having a miter opening therein intermediate the ends thereof locating closer to one axial end thereof than to the axially opposed end;

said miter opening having its apex adjacent one said flange and extending through the other said flange to permit portions of said I beam on axially opposed sides of said miter opening to assume an angled relationship.

18. A therapeutic pillow as defined in claim 17, wherein said I beam comprises a plurality of cells interconnected in gas flow relationship.

* * * * *